US007977302B2

(12) United States Patent
Chakrabarty et al.

(10) Patent No.: US 7,977,302 B2
(45) Date of Patent: Jul. 12, 2011

(54) DETERGENT BAR COMPOSITION

(75) Inventors: Debojit Chakrabarty, Goregaon (IN); Amit Kumar Chaudhary, East Lansing, MI (US); Srilaxmi Venkata Medepalli, Bangalore (IN); Kalpana Kamlakar Nayak, Bangalore (IN)

(73) Assignee: Conopco, Inc., Englewood Cliffs, NJ (US)

( * ) Notice: Subject to any disclaimer, the term of this patent is extended or adjusted under 35 U.S.C. 154(b) by 113 days.

(21) Appl. No.: 12/086,094

(22) PCT Filed: Nov. 16, 2006

(86) PCT No.: PCT/EP2006/010955

§ 371 (c)(1),
(2), (4) Date: Jun. 5, 2008

(87) PCT Pub. No.: WO2007/065538

PCT Pub. Date: Jun. 14, 2007

(65) Prior Publication Data

US 2009/0286706 A1 Nov. 19, 2009

(30) Foreign Application Priority Data

Dec. 7, 2005 (IN) ..... 1511/MUM/2005

(51) Int. Cl.
*C11D 17/00* (2006.01)

(52) U.S. Cl. ..... 510/447; 510/152; 510/153; 510/141; 510/454; 510/507

(58) Field of Classification Search ..... None
See application file for complete search history.

(56) References Cited

U.S. PATENT DOCUMENTS

| | | | | |
|---|---|---|---|---|
| 4,118,332 | A | 10/1978 | Apostolatos et al. | |
| 5,062,994 | A | 11/1991 | Imperatori | |
| 5,403,506 | A | 4/1995 | Jones | |
| 2001/0018068 | A1 * | 8/2001 | Lorenzi et al. | 424/443 |

FOREIGN PATENT DOCUMENTS

| | | |
|---|---|---|
| BE | 510 298 | 9/1953 |
| GB | 2 160 216 | 12/1985 |
| JP | 10 212489 | 1/1997 |
| JP | 2003 138295 | 10/2001 |
| WO | 99/35226 | 7/1999 |
| WO | 2004/046294 | 6/2004 |
| WO | 2005/115307 | 12/2005 |

OTHER PUBLICATIONS

International Search Report, PCT/EP2006/010955, mailed Jan. 26, 2007, 3 pp.

* cited by examiner

*Primary Examiner* — Necholus Ogden, Jr.
(74) *Attorney, Agent, or Firm* — Alan A. Bornstein

(57) ABSTRACT

A detergent composition comprising 40 to 80% by weight soap, 2 to 10% by weight Zinc oxide, and balance of other conventional ingredients, wherein at least 25% by weight of said soap is a salt of Lauric acid.

7 Claims, No Drawings

DETERGENT BAR COMPOSITION

TECHNICAL FIELD

The present invention relates to detergent compositions, particularly; to personal wash compositions with synergistic antibacterial activity.

BACKGROUND AND PRIOR ART

Personal wash compositions are available in various forms such as soap bars, transparent soap bars including cast-bars, liquid soaps including liquid hand wash compositions, creams and gel based products. Commercial soap compositions have one or more "soaps", which has the meaning as normally understood in the art; salts of mono carboxylic fatty acids. The counterions of the salts are generally sodium, potassium, ammonium and alkanolammonium ions, but other suitable ions known in the art may also be used. Compositions based on soaps, i.e. soap bars generally contain over about 70% by weight alkali metal salt of fatty acids, which accounts for the total fatty matter (TFM), the remainder being water (about 10-20%) and other ingredients such as metal ion chelators, color, perfume, preservatives etc. Structurants and fillers are also frequently added to such compositions in small amount to replace some of the soap, while retaining the desired properties of the product. Soaps having TFM content of about 70 are called "toilet soaps", whereas those having TFM of about 40 are called "bathing bars".

Synthetic surfactants are sometimes, also added to soap based personal wash compositions to achieve better product performance. On the other hand, compositions based entirely on synthetic surfactants are also known in the art.

There are several types of microorganisms, such as bacteria, virus and molds, present in the atmosphere, some of which prefer to live and multiply on human skin. Some of these organisms that reside on human skin, cause undesirable conditions such as body odor, pimples and acne, which are cosmetically un-acceptable to people. These conditions are further aggravated by hot and humid climatic conditions. One way to get rid of these microorganisms residing on the skin is to wash them off, while having bath or while washing hands, preferably using a washing composition, such as soap.

Soaps per-se, are known to have possess antimicrobial properties. In addition, specially formulated germicidal soaps are also known in the art, which are used to treat serious skin disorders like scabies. To provide antibacterial benefits through soap compositions, it is necessary to add germicides or antibacterial agents to the formulation. Thus, for example, bars containing antimicrobials such as triclosan (i.e., 2,4,4'-trichloro-2'-hydroxy-diphenylether; TCN) and triclocarbanilide; TCC are known. Especially useful are antibacterial cleansing compositions, such as soap bars, that typically are used to cleanse the skin and to destroy bacteria and other microorganisms present on the skin, especially the hands, arms, and face of the user. Antibacterial compositions are used, for example, in the health care industry, food service industry, meat processing industry, and by individual consumers. The widespread use of antibacterial compositions indicates the importance that consumers place on controlling the population of bacteria and other microorganism on the skin.

Antibacterial personal wash compositions have also been reported in prior art.

JP2003138295 (Pelican Soap Company) describes a molded solid soap having 1% bentonite, 95.9% soap base material, 1% medical carbon, 1% kaolin, 1.00 wt. % perfume, and 1% papain powder. This composition has antibacterial properties. A drawback of such a composition is the use of medical carbon and enzyme (papain), which are difficult to incorporate in soaps. Another drawback is that the black particles of medical carbon, present in the soap bar would be readily visible; therefore it is likely that the product would lack consumer appeal.

U.S. Pat. No. 5,403,506 (Church & Dwight Co., Inc, 1995) provides a deodorant detergent composition containing a soap or synthetic surfactant and Zinc oxide having particle size less than 10 microns as a deodorizing component. It is further preferred that the composition also contains a minor amount of sodium bicarbonate. The composition is useful as a personal toilet soap or detergent composition.

U.S. Pat. No. 5,062,994 (Diana Imperatori, 1991) describes a moisture free skin cleansing composition in tablet form comprising a skin cleansing powder selected from certain anionic or non-ionic surface active agents and at least one absorbing powder selected from the group consisting of cellulose, modified starches, kaolin, bentonite, talc, silicates, silica, magnesium carbonates, magnesium hydroxides, attapulgite, montmorillonite and mixtures thereof, a lubricating material and a disaggregating substance.

Among the fatty acid soaps, Lauric acid soaps are known, and products that contain higher proportion of lauric acid soaps in the formulation are available. These soaps typically contain about 25 to 35% Lauric soaps, in combination with other non-Lauric soaps.

Zinc oxide is an antimicrobial active, reported in several personal wash compositions.

The present inventors have surprisingly found that a combination of Lauric acid soap and Zinc oxide, when used together in a personal wash composition, works synergistically and provides superior benefits in controlling the microbial activity on the surface of the skin by efficient cleaning of the skin. It has therefore become possible to prepare an efficacious antibacterial personal wash composition by employing lower levels of zinc oxide to demonstrate antibacterial benefit.

The present invention thus addresses the need for personal wash compositions that exhibit enhanced antibacterial properties, without compromising on the desired sensorials of soap usage by the consumer.

OBJECTS OF THE INVENTION

It is thus an object of the present invention to provide a personal wash composition having synergistic combination of antimicrobial ingredients.

It is another object of the present invention to provide a personal wash composition comprising ingredients, which are readily available and can be easily incorporated in the composition.

SUMMARY OF THE INVENTION

According to an aspect, the present invention relates to a detergent composition comprising a) 40 to 80% by weight soap, b) 2-10% by weight Zinc oxide, and c) Balance of other conventional ingredients, wherein at least 25% by weight of said soap is a salt of Lauric acid.

Preferably, the salt of Lauric acid is Sodium or Potassium Laurate.

According to a preferred aspect, the composition further comprises 1 to 20% by weight clay belonging to the Smectite class.

The manner in which the present invention addresses these needs is described in greater detail below.

DETAILED DESCRIPTION

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention.

Antibacterial soaps and personal wash compositions are well known in the art. Such compositions are available in various product formats such as toilet soaps, bathing bars, hand-wash liquids, body-wash liquids and antibacterial soap wipes. Increasing awareness about hygiene, coupled with the continuously increasing national and international standards of urban and rural hygiene have caused a large demand for such products. The usage of antibacterial soaps is not only limited to people living in rural areas, but has also become a part of the everyday hygiene program of people living in modern cities.

Soaps are defined as salts of fatty acids, which are prepared by neutralizing the corresponding fatty acid or oil with a base, such as Sodium hydroxide, Potassium hydroxide, Ammonium hydroxide or Triethylamine. Alkali metal salts of carboxylic acids are prepared by neutralizing the corresponding fatty acid or by treating an oil (triglyceride) having the required fatty acid composition with an alkali. The latter process is commonly known as saponification. The alkali used is either the corresponding metal hydroxide or the metal carbonate. Coconut oil and Palm kernel oil are rich in Lauric acid and therefore, could also be used as precursors of lauric salts used according to the invention. Alkali metal salts of the invention are preferably selected from Sodium salt, potassium salts or a mixture thereof. If Sodium salts are used as described in the invention the resultant composition is solid soaps. Potassium salts, on the other hand, lead to a softer product, which is especially preferred when the desired product is a liquid soap. A mixture of sodium and potassium salts lead to products with intermediate degree of hardness/softness and a person skilled in the art, depending upon the requirement, can suitably balance this ratio.

Soaps, per-se have some antimicrobial activity, which is further enhanced by use of various antimicrobial actives such as TCC, TCN, Zinc oxide and ZPTO. Among soaps, lauric acid soaps are known to posses high antimicrobial activity.

Zinc oxide is an antibacterial active, which is widely used in personal wash compositions.

Soap compositions typically have the laurate and the non-laurate soaps associated with them. While coconut oil or coconut fatty acid serve as precursors for laurate soap the saponification of a distilled fatty acid blend, leads to the generation of the non-laurate soap component in the soap composite.

Distilled fatty acid (DFA) is a mixture of C14 to C18 fatty acids, which include Myristic acid, Palmitic acid, Stearic acid, Oleic acid, Linoleic acid and Linolenic acid. Personal wash compositions are typically made by using combinations of Coconut oil soaps and DFA soaps in the ratio from 80:20 to 20:80 parts by weight. This ratio can be altered to achieve desired results.

The present inventors have found and demonstrated that a surprising synergy exists in a composition containing lauric acid salts and Zinc oxide. These two, in combination provide a superior antibacterial mix that provides greater benefits to the user, while at the same time, preserving the sensory and other desirable attributes of the composition.

The present invention relates to a detergent composition comprising 40 to 80% by weight soap and 2 to 10 parts by weight Zinc oxide, wherein at least 25% of said soap is a salt of Lauric acid.

The term "detergent compositions for the purpose of this invention includes personal wash composition" such as conventional toilet soap bars, bathing bars, body-wash liquid, hand-wash liquids and other formulations used for cleansing the skin of human beings.

The composition of the present invention preferably comprises from 40 to 80%, more preferably from 55 to 76% by weight soap. According to the invention, at least 25% of the soap, preferably 35 to 75% of the soap, is a salt of lauric acid.

Lauric acid is a monocarboxylic fatty acid having 12 carbon atoms. The IUPAC name of Lauric acid is "Dodecanoic acid". It is found, occurring in nature in Palm Kernel Oil and Coconut Oil, to the extent of about 50%. The term "salt of Lauric acid" is used to indicate derivatives of Lauric acid that is neutralized using an alkali/alkaline material. Preferably, the salt is a Lithium, Sodium, Potassium, Calcium, Magnesium, Ammonium, Triethylammonium or triethanolammonium salt; more preferably the salt is Sodium or Potassium Laurate. A suitable combination of Sodium and Potassium salts can also be used, without diverting from the scope of the invention.

Zinc oxide (ZnO) is preferably present in the range of 2 to 10% by weight of the composition, more preferably from 4 to 8%, and still more preferably from 4 to 6% by weight. Preferably, it has an average primary (unagglomerated) particle size no higher than about 20 microns. It is further preferred that the primary particle size is in the range of about 0.01 to 5 microns and most preferably about 0.01 to 0.1 micron. The specific surface area of the ZnO is preferably at least about 90 $m^2/g$, e.g. about 90 to 110 $m^2/g$. Due to its small particle size and to avoid excessive dusting and reduction in surface area when contacted with air containing water vapor and $CO_2$, the Zinc oxide can be advantageously stored and added to the composition in the form of a dispersion in an organic liquid which has no adverse effect on the action of the personal wash composition, e.g., $C_{10}/C_{12}/C_{14}$ fatty acid such as coconut fatty acid, triglyceride and octyl palmitate. If the organic liquid is solid at room temperature, it may be liquified by heating during the preparation of the dispersion.

According to a preferred aspect, the composition further comprises from 1 to 20% by weight, more preferably from 2 to 10%, and most preferably from 3 to 8% by weight clay belonging to the Smectite class.

Smectites constitute a group in the class of natural aluminosilicate minerals known as phyllosilicates or layer silicates. Other groups in this class include micas, kaolins, vermiculites, chlorites, talc and pyrophyllite. The phyllosilicate structure consists of layers in which planes of oxygen atoms coordinate to cations such as Si, Al, Mg and Fe to form two-dimensional sheets. The coordination of cations in adjacent sheets typically alternates between tetrahedral and octahedral.

Smectites are characterized by a 2:1 layer structure in which two tetrahedral sheets form on either side of an octahedral sheet through sharing of apical oxygens. As the apical oxygens from the tetrahedral sheet form ditrigonal or hexagonal rings, one oxygen from the octahedral sheet is located on the centre of each ring and is protonated to yield a structural hydroxyl. In 2:1 phyllosilicates, isomorphous substitution of cations having different valencies can lead to charge imbalances within a sheet. These may be partly balanced by the opposite type of charge imbalance in the adjacent sheet (e.g., a positively charged octahedral sheet may offset some of the negative charge associated with a tetrahedral sheet). The net charge imbalance on a 2:1 layer, if it occurs, is negative. This charge is referred to as the layer charge of the mineral and is balanced by larger cations (e.g., $Na^+$, $K^+$, $Ca^{+2}$ and $Mg^{+2}$) that coordinate to the basal surfaces of the tetrahedral sheets from the adjacent layers. Since, these charge-balancing cations are located between adjacent 2:1 layers they are referred to as "interlayer cations". The 2:1 phyllosilicates are distinguished chiefly on the basis of their layer charge.

The compounds/clay materials belonging to the class of smectites is quite large, and, especially, the Cs exchanged classes of smectites include hectorite, saponite, and montmorillonite, in addition to vermiculite, and, several non exchangeable phyllosilicates.

The preferred clays as per this invention are selected from one or more of Montmorillonite, Sodium and Calcium montmorillonite, Bentonite, Calcium and Sodium bentonites, Laponite and Saponite, more preferably the clay is Bentonite, Saponite or Laponite and most preferably the clay is Sodium Bentonite.

Additional Ingredients

The composition, according to the invention, can optionally comprise detergent actives, which are generally chosen from anionic, nonionic, cationic, amphoteric or zwitterionic detergent actives. It is preferred that if non-soap detergents are used in the composition of the invention, the non-soap detergent is chosen from anionic or non-ionic detergent active. Synthetic detergents contain a relatively polar hydrophilic group and a relatively non-polar hydrophobic group.

The synthetic detergents contemplated, as surfactants under this invention are compounds other than soap whose detersive properties, like soap, are due to the presence of a hydrophilic and a hydrophobic group in the molecule. However, unlike soaps, synthetic detergents are not salts of carboxylic acids derived from fats and oils. Rather, the hydrophobic portion of the surfactant of a synthetic detergent is generally derived from a compound containing a relatively long carbon chain, e.g., a hydrocarbon obtained from petroleum refining and/or olefin polymerization or a long chain fatty acid, while the hydrophilic portion is the result of chemical modification of such compound to introduce the desired polar group, e.g., a hydroxyl, sulfate or sulfonate group.

The synthetic detergent compositions of this invention generally contain at least one anionic or nonionic surfactant or a mixture of the two types of surfactant. The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

Specific sulfated surfactants which can be used in the compositions of the present invention include sulfated ethoxylated and unethoxylated fatty alcohols, preferably linear primary or secondary monohydric alcohols with $C_{10}$-$C_{18}$, preferably $C_{12}$-$C_{16}$, alkyl groups and, if ethoxylated, on average about 1-15, preferably 3-12 moles of ethylene oxide (EO) per mole of alcohol, and sulfated ethoxylated alkylphenols with $C_8$-$C_{16}$ alkyl groups, preferably $C_8$-$C_9$ alkyl groups, and on average from 4-12 moles of EO per mole of alkyl phenol.

The preferred class of sulfated ethoxylated surfactants are the sulfated ethoxylated linear alcohols, such as the $C_{12}$-$C_{16}$ alcohols ethoxylated with an average of from about 1 to about 12 moles of ethylene oxide. A most preferred sulfated ethoxylated detergent is made by sulfating a $C_{12}$-$C_{15}$ alcohol ethoxylated with 3 moles of ethylene oxide.

Specific nonionic surfactants which can be used in the compositions of the present invention include ethoxylated fatty alcohols, preferably linear primary or secondary monohydric alcohols with $C_{10}$-$C_{18}$, preferably $C_{12}$-$C_{16}$, alkyl groups and on average about 1-15, preferably 3-12 moles of ethylene oxide (EO) per mole of alcohol, and ethoxylated alkylphenols with $C_8$-$C_{16}$ alkyl groups, preferably $C_8$-$C_9$ alkyl groups, and on average about 4-12 moles of EO per mole of alkyl phenol.

The preferred class of nonionic surfactants compounds are the ethoxylated linear alcohols, such as the $C_{12}$-$C_{16}$ alcohols ethoxylated with an average of from about 1 to about 12 moles of ethylene oxide. A most preferred nonionic detergent is a $C_{12}$-$C_{15}$ alcohol ethoxylated with 3 moles of ethylene oxide.

Mixtures of the foregoing synthetic detergent type of surfactants, e.g., of anionic and nonionic, or of different specific anionic or nonionic surfactants, may be used to modify the detergency, lather characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of anionic and nonionic surfactants or different specific anionic or nonionic surfactants. When present, surfactants are preferably in the range of 5-50% by weight, more preferably from 8 to 30%, furthermore preferably from 10 to 25% by weight of the composition.

Conventional Ingredients

Benefit agents e.g. moisturisers, emollients, sunscreens, or anti ageing compounds may be incorporated in the composition of the invention. Examples of moisturisers and emollients include humectants like polyols, glycerol, cetyl alcohol, carbopol, ethoxylated castor oil, paraffin oils, lanolin and its derivatives. Silicone compounds such as silicone surfactants like DC3225C (Dow Corning) and/or silicone emollients, silicone oil (DC-200 Ex-Dow Corning) may also be included. Sun-screens such as 4-tertiary butyl-4'-methoxy dibenzoylmethane (available under the trade name PARSOL 1789 from Givaudan) and/or 2-ethyl hexyl methoxy cinnamate (available under the trade name PARSOL MCX from Givaudan) or other UV-A and UV-B sun-screens may also be incorporated. Water soluble glycols such as propylene glycol, ethylene glycol, glycerol, may be employed at levels up to 10%. Other additives such as one or more water insoluble particulate materials e.g. polysaccharides such as starch or modified starches and cellulose may be incorporated. Minor additives include metal ion chelators or sequesterants, colour, preservatives and perfumes, may optionally be incorporated. The detergent composition of this invention may also contain varying quantities of compatible adjuvants. Typical of such compatible adjuvants are fillers and pigments such as titanium dioxide, diatomaceous earth, any of various colored pigments, dyes, fragrances, optical brighteners and bactericidal and bateristatic compounds other than zinc oxide such as cetylpyridinium chloride, TCC, Zinc pyrithione and TCN.

The composition can be made in solid form such as bars, flakes, chips, or powders or in liquid form, such as hand-wash and body wash compositions. The composition can be formed into framed (cast) soap or milled soap bars in accordance with the general procedure of the soap making art.

The term total fatty matter, usually abbreviated to TFM is used to denote the percentage by weight of fatty acid and triglyceride residues present in soaps without taking into account the accompanying cations.

The soap can be obtained by saponifying a fat/oil and/or a fatty acid. The fats or oils generally used in soap manufacture may be such as tallow, tallow stearines, palm oil, palm stearines, soya bean oil, fish oil, caster oil, rice bran oil, sunflower oil, coconut oil, babassu oil, palm kernel oil, and others. In the above process the fatty acids are derived from oils/fats selected from coconut, rice bran, groundnut, tallow, palm, palm kernel, cotton seed, soybean, castor etc. The fatty acid soaps can also be synthetically prepared (e.g. by the oxidation of petroleum or by the hydrogenation of carbon monoxide by the Fischer-Tropsch process). Resin acids, such as those present in tall oil, may be used. Naphthenic acids are also suitable.

Tallow fatty acids can be derived from various animal sources and generally comprise about 1-8% myristic acid, about 21-32% palmitic acid, about 14-31% stearic acid, about 0-4% palmitoleic acid, about 36-50% oleic acid and about 0-5% linoleic acid. A typical distribution is 2.5% myristic acid, 29% palmitic acid, 23% stearic acid, 2% palmitoleic acid, 41.5% oleic acid, and 3% linoleic acid. Other similar mixtures, such as those from palm oil and those derived from various animal tallow and lard are also included.

Coconut oil refers to fatty acid mixtures having an approximate carbon chain length distribution of 8% C8, 7% C10, 48% C12, 17% C14, 8% C16, 2% C18, 7% oleic and 2% linoleic acids (the first six fatty acids listed being saturated).

Other sources having similar carbon chain length distributions, such as palm kernel oil and babassu kernel oil, are included within the term coconut oil.

Process

A process for making the soap bars in accordance with one exemplary embodiment of the present invention will now be described.

The soap components of the soap bars may be manufactured by mixing a fatty acid or acids and at least one neutralizing agent in an open agitated reaction vessel at atmospheric pressure and heating to a temperature sufficient to melt the fatty acids, generally at least about 80° C. to 90° C. The fatty acids include Lauric acid and monocarboxylic fatty acids having alkyl chain lengths of 14 carbon atoms to 22 carbon atoms (C10). Suitable neutralizing agents for manufacturing of the soap bars of the present invention include caustic solutions, for example, sodium bases such as NaOH. The neutralizing agent neutralizes the fatty acids, forming salts of the fatty acids (i.e., "soaps"), such as for example, sodium, potassium, ammonia or alkanolammonium salts. The neutralizing agent may be added in an amount less than the amount of the neutralizing agent required to fully neutralize the fatty acids. In one exemplary embodiment of the invention, about 95% of the required amount of neutralizing agent needed to fully neutralize the fatty acids may be added. The temperature preferably is maintained above about 80° C. but below about 100° C.

Optionally at this point, the mixture may be analyzed for free acid and the pH of the mixture manipulated accordingly. For example, the mixture may be titrated with NaOH using a pH indicator and, if necessary, the composition of the mixture may be manipulated so that a 10% aqueous solution of the resulting soap bar has a pH no greater than about 9. For example, if the pH is too acidic, more neutralizing agent may be added. Alternatively, if the mixture has a pH above about 9, more free fatty acids may be added to the composition. If free fatty acids are added, it is preferable that the free fatty acids have alkyl chains of 8 to 10 carbon atoms.

At this stage of the manufacturing process, the temperature of the reaction mixture may be raised to at least about 90° C., preferably from about 90° C. to about 100° C., to evaporate a desired amount of water. Alternatively, the water may be evaporated before addition of an additional neutralizing agent or free fatty acid as described above. In one embodiment of the invention, the soap bar comprises no more than 25% water. Preferably, the soap bar comprises no more than 20% water. More preferably, the soap bar comprises no more than 15% water. When a desired amount of water has been removed from the soap component, the soap component may be cooled, followed by the addition of ZnO and clays and optional ingredients also may be added to the soap component using conventional methods. The resulting composition may be formed into soap bars, either by pouring the composition, in a molten state, into molds, or, alternatively, by forming soap bars using conventional milling, plodding and/or stamping procedures as is well known in the art.

To provide a more complete understanding of the present invention and not by way of limitation, reference is made to the following examples. However, one of ordinary skill in the art would appreciate that various modifications and changes can be made without departing from the scope of the present invention. Accordingly, the examples are to be regarded in an illustrative rather than a restrictive sense, and all such modifications are intended to be included within the scope of present invention.

EXAMPLE 1

To Demonstrate the Effect of Zinc Oxide in the Formulation

Milled-plodded soap compositions having the following formulations were made according to the process as described above.

| | Components | | |
|---|---|---|---|
| Total soap content | % Dry Basis ~55 (A) | % Dry Basis ~65 (B) | % Dry Basis ~72 (C) |
| C8 fatty acid Sodium soap | 2.40 | 2.62 | 3.00 |
| C10 fatty acid Sodium soap | 1.95 | 2.34 | 2.60 |
| Sodium Laurate | 14.80 | 17.75 | 19.75 |
| Sodium Myristate | 6.25 | 7.10 | 7.90 |
| Sodium Palmitate | 15.50 | 18.46 | 20.55 |
| Sodium Stearate | 2.00 | 2.27 | 2.56 |
| Sodium Oleate | 13.20 | 16.23 | 18.17 |
| Sodium Linoleate | 3.50 | 4.26 | 4.75 |
| Glycerine | 4.10 | 4.10 | 0.00 |
| Sorbitol | 8.40 | 3.50 | 0.00 |
| Zinc Oxide | 2.00 | 2.00 | 2.00 |
| Bentonite | 5.00 | 5.00 | 5.00 |
| Water | 18.13 | 12.08 | 12.02 |
| Minor ingredients | balance | balance | balance |
| Total (approx) | 100.00 | 100.00 | 100.00 |

Note: Control soaps, in all the above cases were also made, without any Zinc oxide.

In Vitro Data:

The effect of the soap formulations on the growth of *Staphylococcus epidermidis*, a common skin bacterium was evaluated by determining the effect of one minute exposure of bacteria to 8% soap suspension. The growth curve of the test bacterium was followed post exposure and increase in the lag/decrease in the final growth (as determined by optical density) was determined.

Reference: "General Microbiology" 5th ed.

Authors: Roger Y Stanier, John L Ingraham, Mark L Wheelis, Page R Painter

Pub: Macmillan education ltd., Hampshire and London.

Determination of Growth Retardation Index (GRI) by the Microtitre Plate Assay

Preparation of Culture on Microtitre Plates

An 18 hour old culture of *S. epidermidis* grown on a culture medium having the composition as mentioned below was used for the assay. A saline suspension of the culture was adjusted to an optical density of 0.2 at 620 nm corresponding to approx. $1\times10^7$ cfu/ml using a spectrophotometer. 100 μL of this saline suspension were placed in the wells of the microtitre plates. The plates were then left at room temperature for 2 hours to allow the cells to settle under gravity. The supernatant was then removed.

Composition of Culture Medium

| | | |
|---|---|---|
| Blood Agar base number 2 | 12.5 g | (HI Media Company) |
| Dextrose | 0.3 g | (Ditco Company) |
| Yeast extract | 0.9 g | (HI Media Company) |
| Tween-80 | 1.5 g | (SD Fine Chem) |
| Deionised water | 300 ml | |

Soap Sample Preparation

8% suspension of the soap compositions were prepared in distilled water.

Treatment of Adhered *S. epidermidis*

Microtitre plate wells were treated with 100 μL of the 8% soap suspension for 1 min. The soap suspension was then pipetted out of the wells and the wells rinsed twice with 100 μL of sterile distilled water. Control soap was prepared without Zinc oxide.

Measurement of Antimicrobial Activity

200 μL of sterile BHI broth supplemented with glucose and Tween 80 were added to each well and the OD was measured every 30 min at 630 nm for 24-48 hrs at 37° C. using a plate reader. The growth curve was plotted for each sample tested as a mean of triplicates.

The Growth Retardation Index was calculated as follows:

$$\frac{\text{Time (mid log of control soap)} \times \text{(Maximum} - \text{Minimum } OD \text{ of test soap)}}{\text{Time (mid log of test soap)} \times \text{(Maximum} - \text{Minimum } OD \text{ of control soap)}}$$

Lower GRI is a marker of better antibacterial activity and therefore. In the above procedure, OD stands for the Optical density.

Results of the experiment have been summarized in table-1 below.

TABLE 1

| Composition | Lauric salt (Sodium) content in the composition, as % of soap content | Growth Retardation Index: Control soap | Growth Retardation Index: Soap with 2% ZnO |
|---|---|---|---|
| A | ~26% | ~0.3 | 0.08 |
| B | ~26% | ~0.3 | 0.08 |
| C | ~25% | ~0.3 | 0.08 |

In the above examples, the Sodium laurate salt is present at ~25% of the total soap content in the composition. It can be readily seen that addition of 2% Zinc oxide reduces the "Growth Retardation Index" from 0.3 to about 0.08, which demonstrates the antibacterial efficacy of the composition of the present invention vis-à-vis control soap composition, which is devoid of Zinc oxide.

EXAMPLE 2

Demonstration of Effect of % Lauric Salt Content

Another set of experiment was carried out to demonstrate the effect of addition of Zinc oxide and Lauric salt content on the antibacterial efficacy of the composition. The GRI of composition "C" was compared against commercially available soap containing ~72% by weight soap. The GRI was measured as described above.

Results of the experiment are presented in the table-2 below.

TABLE 2

| Composition | Total soap content (% by weight of composition) | % Zinc Oxide | Sodium Laurate content (% by weight of soap content) | GRI |
|---|---|---|---|---|
| Commercial | 72 | 0 | ~10% | 0.95 |
| Commercial | 72 | 2 | ~10% | 0.85 |
| Composition C (without ZnO) | 72 | 0 | ~25% | 0.3 |
| Composition C | 72 | 2 | ~25% | 0.08 |

From the above table, it is clear that when the Lauric salt content is ~10% by weight of total soap content, the antibacterial efficacy of commercial soap devoid of Zinc oxide as measured by GRI is 0.95, which does not significantly reduce upon incorporation of 2% Zinc oxide (GRI=0.85).

On the other hand, a soap composition, comprising 25% by weight Sodium salt of Lauric acid (devoid of Zinc oxide) showed antibacterial activity as measured by GRI of 0.3, while that of the composition according to the invention (containing 2% Zinc oxide) was found to be significantly lower, at 0.08.

EXAMPLE 3

Demonstration of Synergistic Effect of Lauric Salt, ZnO and Bentonite

The synergistic efficacy of lauric soap, Zinc Oxide and Bentonite was studied by In-vivo "Cup Scrub Assay". Following four soap compositions, as per table-3 below, (~55% total soap content) were made and evaluated for their antibacterial efficacy as per the procedure described below.

TABLE 3

| Components | Composition: AA % w/w | BB % w/w | CC % w/w | DD % w/w |
|---|---|---|---|---|
| $C_8$ fatty acid Sodium soap | 2.40 | 2.40 | 2.40 | 2.40 |
| $C_{10}$ fatty acid Sodium soap | 1.95 | 1.95 | 1.95 | 1.95 |
| Sodium Laurate | 14.80 | 14.80 | 14.80 | 14.80 |
| Sodium Myristate | 6.25 | 6.25 | 6.25 | 6.25 |
| Sodium Palmitate | 15.50 | 15.50 | 15.50 | 15.50 |
| Sodium Stearate | 2.00 | 2.00 | 2.00 | 2.00 |
| Sodium Oleate | 13.20 | 13.20 | 13.20 | 13.20 |
| Sodium Linoleate | 3.50 | 3.50 | 3.50 | 3.50 |
| Glycerine | 4.10 | 4.10 | 4.10 | 4.10 |

TABLE 3-continued

| Components | Composition AA % w/w | BB % w/w | CC % w/w | DD % w/w |
|---|---|---|---|---|
| Sorbitol | 8.40 | 8.40 | 8.40 | 8.40 |
| Zinc Oxide | — | — | 2.0 | 2.0 |
| Bentonite | — | 5.0 | — | 5.0 |
| Water | 18.13 | 18.13 | 18.13 | 18.13 |
| Minor Ingredients | balance | balance | balance | balance |
| Total (approx) | 100.00 | 100.00 | 100.00 | 100.00 |

Protocol for the Assay 20 panelists were selected and they were split into 4 groups of 5 each. Group-1 tested composition AA v/s commercial soap with the following specifications.

Total soap content ~72 wt %

Total Sodium Laurate content —(approx) 10% by weight of the soap content.

No Zinc oxide OR Bentonite

Similarly, the other three groups tested compositions BB, CC and DD v/s commercial soap as described above. For one week prior to the test, all panelists used commercial non-antibacterial soap for routine washing and refrained from using any topical antimicrobials. Panelists also refrained from washing the test area 24 hours before the test day.

The forearms of the Panelists were divided into 5 zones, starting from the elbow, down to the wrist. Each of these zones, were earmarked for sample collection at the following 5 stages.

1. Pre-wash sample
2. Zero hour sample, immediately after washing
3. 2 hour sample (2 hours after washing)
4. 4 hour sample
5. 6 hour sample On the test day, panelists reported without having bath and pre-wash samples were collected as mentioned in procedures below. Sampling was done once for each location. One arm was used to test the experimental soaps (compositions AA, BB, CC and DD, while the other was used to test the commercial soap composition, as described in the tables below.

Soap Application:

Panelists had controlled washing of both left and right forearms in the laboratory. Soap was applied on the forearms of the panelists by the analysts using disposable gloves. The test area of left/right forearm was moistened/wetted with tap water. The control soap to be applied was moistened and then rubbed on the test area of left/right for 15 seconds. The analyst lathered the test area with the gloved hand for 15 seconds. If the lather became too dry, a small amount of water was added to maintain lather. The subject then rinsed the left test area with tap water for 30 seconds to remove all lather. The test area was patted dry with the toweling/tissue paper provided. The same procedure was repeated for the other forearm with the control soap or the test soap as applicable. The right forearm was used for application of the control soap while the left forearm was used for the application of the test soap.

Post-Wash Sampling:

Samples were collected from both left and right forearm sites, immediately after soap application in the same way as for pre-wash sampling and also 2, 4 and 6 hours after washing.

Procedure for Sampling

The area to be sampled was delineated by a sterile sampling cylinder. The cylinder was pressed firmly against the skin surface during sampling to ensure that the washing fluid did not leak from the sampling site. A 1.5-ml portion of sampling fluid was added to the cylinder and the entire area was scrubbed with moderate pressure using a sterile glass rod for one minute. The sampling fluid was removed and pipetted into a sterile sample tube. This procedure was repeated with a fresh aliquot of sampling fluid, and the samples so collected were pooled. The sample containers were labelled with the subject number, sampling site and time. Additional test sites were sampled in the same way.

Composition of Sampling Fluid

| | |
|---|---|
| Butterfield's Phosphate Buffer Stock Solution | 1.25 ml |
| Polysorbate 80 (Tween 80) | 5 g (Hi Media) |
| Lecithin | 0.7 g (Hi Media) |
| Triton X-100 | 1 g |
| Distilled water | 1000 ml |

Enumeration of Samples for Bacterial Counts:

The cup scrub samples collected at different sampling time intervals were diluted serially and two dilutions were plated in duplicate using the pour plate method on CY agar plates (composition of culture medium, CY Agar is listed elsewhere in this document). The plates were incubated at 37° C. for 48 hours. The colonies were counted and recorded.

Bacterial count/ml was calculated considering, dilution factor as per standard microbiological counting procedures and the amount was extrapolated to determine the residual bacterial counts per square cm of the skin (forearm) of the panelist. The tables 4-7 below give the mean value of counts/sq.cm at 4 hours (of 5 panellists) after washing with the control and experimental soap compositions, as listed in table-3.

TABLE 4

| Group number 1 - Control composition (AA) v/s Commercial soap | |
|---|---|
| Composition | Counts/sq. cm at 4 hours, after wash |
| AA | $7.2 \times 10^3$ |
| Commercial soap | $6.82 \times 10^3$ |

TABLE 5

| Group number 2 - Composition (BB) v/s Commercial soap | |
|---|---|
| Composition | Counts/sq. cm at 4 hours, after wash |
| BB | $1.1 \times 10^4$ |
| Commercial soap | $1.27 \times 10^4$ |

TABLE 6

| Group number 3 - Composition (CC) v/s Commercial soap | |
|---|---|
| Composition | Counts/sq. cm at 4 hours, after wash |
| CC | $8.8 \times 10^3$ |
| Commercial soap | $4.6 \times 10^4$ |

TABLE 7

| Group number 4 - Composition (DD) v/s Commercial soap | |
|---|---|
| Composition | Counts/sq. cm at 4 hours, after wash |
| DD | $2.37 \times 10^3$ |
| Commercial soap | $1.02 \times 10^5$ |

Thus, it can be seen from the results summarized in the above tables that a composition according to a preferred aspect of the invention (DD), comprising (~25% Sodium Laurate, 2% Zinc oxide and 5% Bentonite), gives superior antibacterial efficacy, which is evident from the difference in counts/sq.cm of table-8.

From the foregoing description, it becomes readily clear that a new and efficacious detergent composition has been herein described and illustrated which fulfils some of the afore stated objectives.

The invention thus provides a synergistic detergent composition that gives superior antibacterial activity.

The invention claimed is:

1. A detergent composition comprising:

a) 40 to 80% by weight soap b) 2 to 10% by weight Zinc oxide, and c) Balance of other conventional ingredients, wherein 35 to 75% by weight of said soap is a salt of Lauric acid.

2. The detergent composition as claimed in claim 1, comprising 1 to 20% by weight clay belonging to the Smectite class.

3. The detergent composition as claimed in claim 2 wherein said clay is from 2 to 10% by weight of said composition.

4. The detergent composition as claimed in claim 2, wherein said clay is selected from Bentonite, Laponite or Saponite or mixtures thereof.

5. The detergent composition as claimed in claim 1, wherein said soap is from 55 to 76% by weight of said composition.

6. The detergent composition as claimed in claim 1, wherein said salt of Lauric acid is Sodium or Potassium laurate.

7. The detergent composition as claimed in claim 1 wherein said Zinc oxide is from 4 to 8% by weight of said composition.

* * * * *